US006728090B2

(12) United States Patent
Hauser et al.

(10) Patent No.: US 6,728,090 B2
(45) **Date of Patent: *Apr. 27, 2004**

(54) DEVICE FOR PLACING A CHARGE ON AN OBJECT AND A METHOD OF RETROFITTING A CONVEYOR FOR THE DEVICE

(75) Inventors: Roy C. Hauser, Phillipsburg, NJ (US); Charles A. King, Mechanics Falls, ME (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/427,441

(22) Filed: May 1, 2003

(65) Prior Publication Data

US 2003/0198003 A1 Oct. 23, 2003

Related U.S. Application Data

(63) Continuation of application No. 09/688,779, filed on Oct. 16, 2000, now Pat. No. 6,590,759.

(51) Int. Cl.[7] ..... H05F 3/00; H01H 47/00

(52) U.S. Cl. ..... 361/225; 361/220

(58) Field of Search ..... 361/225, 226, 361/221, 223, 213, 229

(56) References Cited

U.S. PATENT DOCUMENTS 3,968,405 A * 7/1976 Testone ..... 361/220

5,256,176 A * 10/1993 Matsuura et al. ..... 55/528

OTHER PUBLICATIONS

SIMCO Industrial Static Control "Chargemaster DC Systems" (pamphlet), no author cited, no date cited, p. 8.

The Magnum Pinner, Tantec USA Inc., product release date: unknown, printout from web site: http://www.tantecusa.com/magnum.html, printout date: Mar. 28, 2003, 3 pages.

* cited by examiner

*Primary Examiner*—Rajnikant B. Patel
(74) *Attorney, Agent, or Firm*—Akin Gump Strauss Hauer & Feld, LLP

(57) ABSTRACT

A device places a charge on an object passing by and proximate to the device in a first direction along a transport axis. The device includes a body having a surface. A power input is disposed in the body. A plurality of resistors each have a longitudinal resistor axis and each are capable of receiving power from the power input. Each of the plurality of resistors is disposed in the body with the longitudinal resistor axis being generally parallel to the surface. An ionizing pin is electrically connected to each of the plurality of resistors for receiving power to generate ions. The object is charged by passing the object by and proximate to the surface of the body in the first direction to receive ions generated by the plurality of ionizing pins. The device provides a relatively long object dwell time, thereby increasing the amount of time that the area of the object is exposed to an ion stream from the device. The device also has a low profile, heightwise, and thus may be easily retrofitted into conventional conveyors.

13 Claims, 7 Drawing Sheets

DEVICE FOR PLACING A CHARGE ON AN OBJECT AND A METHOD OF RETROFITTING A CONVEYOR FOR THE DEVICE

CROSS-REFERENCE TO RELATED APPLICATIONS

This application is a continuation of U.S. patent application Ser. No. 09/688,779 filed Oct. 16, 2000, U.S. Pat. No. 6,590,759 entitled "Device For Placing A Charge On An Object And Method Of Retrofitting A Conveyor For The Device".

BACKGROUND OF THE INVENTION

The present invention is related to devices for charging objects during transport and, more specifically, to a device for placing a charge on an object and a method of retrofitting a conveyor for the device.

In many manufacturing, processing and packaging systems, it is desirable to place a charge on an object (often referred to as "pinning" an object) to aid in the proper stacking or alignment of various objects. For example, when stacking catalogs at the end of a conveyer, it is difficult to arrange for each of the catalogs to maintain its position so that the catalogs are positioned in a tight, vertically registered stack. The proper alignment of the catalogs is easier to maintain when a charge is placed on each of the catalogs. The tendency of charged catalogs to "stick" together facilitates transporting a stack of catalogs to another location for strapping and/or shrink-wrapping without catalogs slipping from the stack or becoming otherwise misaligned. Maintaining the catalogs in a properly aligned stack prevents damage to misaligned catalogs during the shrink-wrapping or strapping process.

Another situation in which it is useful to place a charge on objects is when card inserts are being dropped onto a card or sheet being transported along a conveyor. The use of static charge on either the card insert or the sheet aids in the proper positioning of the insert on the sheet. By placing a charge on the insert prior to dropping the insert onto the sheet, the insert is prevented from overshooting the desired placement location on the sheet and is less likely to be dislodged during further processing.

It can also be useful to place a charge on ribbons that are to be tacked together. When two ribbons are being processed so as to overlay each other, it is common for air to become trapped between the ribbons. By placing a static charge on the ribbons, air that is disposed between the ribbons can be displaced which helps prevent "dog ears" and creases in the tacked ribbons. In a similar fashion, placing a charge on a web can be used to firmly position the web on a roller and to reduce slippage between the web and the roller.

When trying to stack multiple sheets of paper prior to shrink wrapping, it is useful to place a static charge on the stack of sheets to bond the sheets of paper together and to keep them in a tight stack during the shrink wrapping process. Similarly, when interleaving a film between various layers of material, such as glass, paper or wood, it is useful to place a charge on the interleaved material to prevent slippage of various layers during the stacking process.

Static charges are also useful when manufacturing objects using in-mold decorating. Static charges can be used to pin a decorative decal tightly against the inner surface of a mold used in an injection molding process. This use of static charge greatly improves the finished product quality by preventing the decal from slipping or changing position in the mold.

While there are many processes that use static charge during the manufacturing packaging or processing of objects, conventional ionizing devices have many drawbacks. Referring to FIG. 1, a conventional ionizer 10' is shown. Referring to FIG. 8, the ionizer 10' has numerous pins 11 linearly aligned along an upper surface which project ions toward an object passing over the ionizer 10'. The ionizer 10' is relatively tall as measured parallel to the pins 11 due to the orientation of resistors 13 in the device 10'. The relatively large height of the conventional ionizer 10' increases the difficulty and expense of retrofitting a conveyor to include the ionizer 10'.

Another drawback of the conventional ionizer 10' is that by using only a single row of pins 11, the dwell time of an object in the ionized area over the ionizer 10' is short which prevents the placing of an adequate charge on objects having a UV coating, such as catalogs or the like. Dwell time is generally the amount of time each area of the object is exposed to ions emitted from the device 10'.

Another problem with the conventional ionizer 10' is that the ion field created by the ionizer 10' is not even. Each pin 11 emits ions in a generally conical fashion with the area closest to the center of the cone receiving a greater amount of ions. Thus, the resulting ion field from a conventional ionizer tends to have interspersed high and low ion concentrations as one moves along a direction parallel to the row of pins 11.

Referring to FIG. 8, the height of the conventional ionizer 10' often makes it necessary to reroute the path of the conveyor belt 12 using additional rollers 70' to accommodate the proper placement of the ionizer 10'. This increases the downtime of the conveyor during retrofitting and, correspondingly, increases the cost of installing the ionizer 10'.

What is needed, but so far not provided by the conventional art, is a device that is capable of placing a charge on an object passing by and proximate to the device, that provides an increased dwell time for objects passing by the device, that has a more evenly distributed ion field, that has a reduced height, and that is easier to retrofit into an existing conveyor. The present invention fulfills these needs.

SUMMARY OF THE INVENTION

Briefly stated, the present invention is directed to a device for placing a charge on an object passing by and proximate to the device in a first direction along a transport axis. The device includes a body having a surface. A first plurality of rows of ionizing pins is disposed in the body for emitting ions from locations proximate to the surface of the body. Each of the first plurality of rows of ionizing pins has a first row axis that is aligned generally parallel to the transport axis. The first plurality of rows of ionizing pins is positioned in a generally spaced apart side by side fashion. A second plurality of rows of ionizing pins is disposed in the body for emitting ions from locations proximate to the surface of the body. Each of the second plurality of rows of ionizing pins has a second row axis that is aligned generally parallel to the transport axis. The second plurality of rows of ionizing pins is positioned in a generally spaced apart side by side fashion. The first plurality of rows of ionizing pins and the second plurality of rows of ionizing pins are disposed so that at least a portion of the object moving in the first direction by and proximate to the surface of the body passes by and proximate to at least one of the plurality of rows of ionizing pins before passing by and proximate to at least one of the second plurality of rows of ionizing pins. The second plurality of rows of ionizing pins are laterally offset with respect to the first plurality of rows of ionizing pins so that the second plurality of rows of ionizing pins is generally aligned with positions between pairs of the first plurality of rows of ionizing pins. The object is charged by passing the object by and proximate to the surface of the body in the first direction to receive ions generated from both the first plurality of rows of ionizing pins and the second plurality of rows of ionizing pins.

The present invention is alternatively directed to a device for placing a charge on an object passing by and proximate to the device in a first direction along a transport axis. The device includes a body having a surface. A power input is disposed in the body. A plurality of resistors each has a longitudinal resistor axis and is capable of receiving power from the power input. Each of the plurality of resistors is disposed in the body with the longitudinal resistor axis being generally parallel to the surface. The plurality of ionizing pins is electrically connected to at least one of the plurality of resistors for receiving power to generate ions. The object is charged by passing the object by and proximate to the surface of the body in the first direction to receive ions generated by the plurality of ionizing pins.

The present invention is alternatively directed to a method of retrofitting a belt conveyor with a device to allow a charge to be placed on an object being transported in a first direction along a transport axis on the belt conveyor. The belt conveyor has a portion moving in the first direction for supporting and transporting the object. The device has a surface and is capable of emitting ions from locations proximate to the surface. The device includes a plurality of resistors each having a longitudinal resistor axis oriented generally parallel to the surface resulting in the device having reduced height as measured perpendicularly to the surface. The method includes positioning a device proximate to the belt conveyor, orienting the device so that the surface faces the portion of the belt conveyor moving in the first direction to allow the device to place the charge on the object being transported by the belt conveyor, and securing the device in position. The reduced height of the device simplifies the retrofitting of the belt conveyor to include the device.

BRIEF DESCRIPTION OF THE SEVERAL VIEWS OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
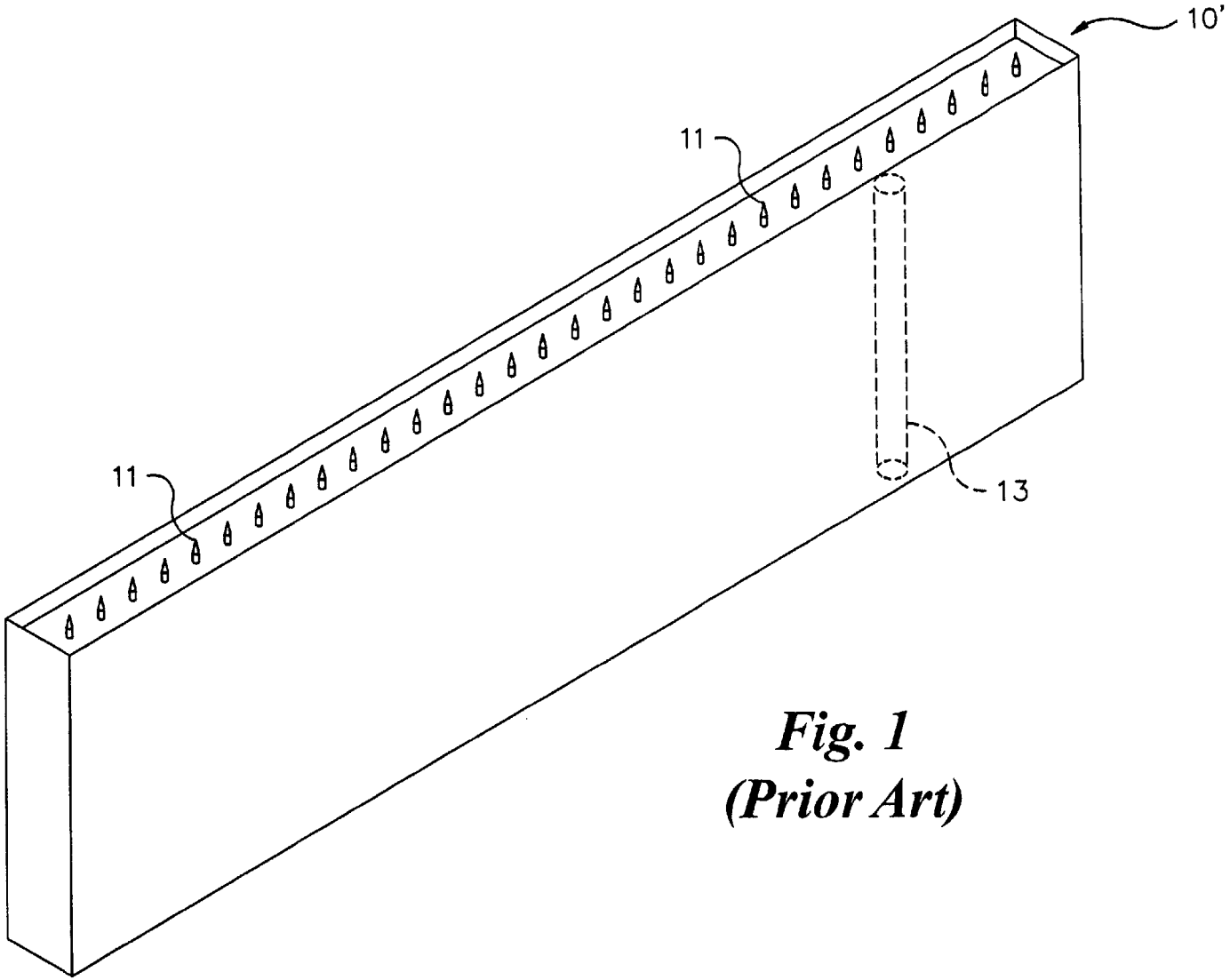
Fig. 1 (Prior Art)
FIG. 1 is a perspective view of a prior art ionizer.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the device and designated parts thereof. Additionally, the word "a," as used in the claims and in the corresponding portions of the specification, means "at least one." "By and proximate to" is used in the claims and in corresponding portions of the specification to describe the passing of an object through the ionized area proximate to the device. "By and proximate to" is used instead of terms that imply a specific orientation, such as "over" or "under" because depending on the specific structure with which the device is used (and depending on the orientation of the ion emitting surface of the device), the object may pass over the device, pass under the device, or pass along a lateral side of the device. "By and proximate to" accurately describes the passing of the object through the ionized area proximate to the surface of the device regardless of the specific orientation of the device relative to the object. The above mentioned terminology includes the words above specifically mentioned, derivatives thereof and words of similar import.

Figure 6:
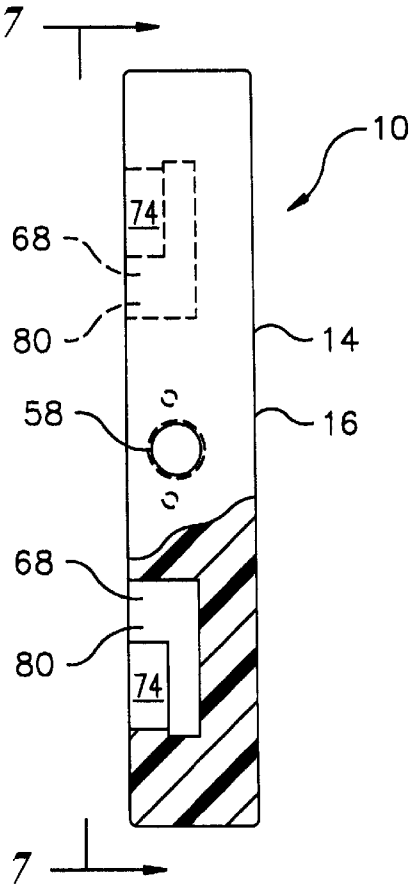
FIG. 6 is a broken away right side elevational view of the device of FIG. 4 as viewed along the line 6—6 of FIG. 4.
Figure 7:
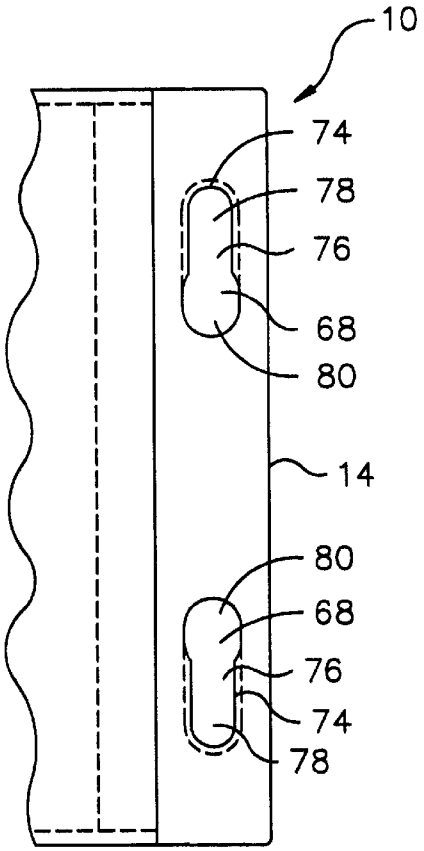
FIG. 7 is a partial top plan view of the device of FIG. 6 as viewed along the line 7—7 of FIG. 6.
Figure 8:
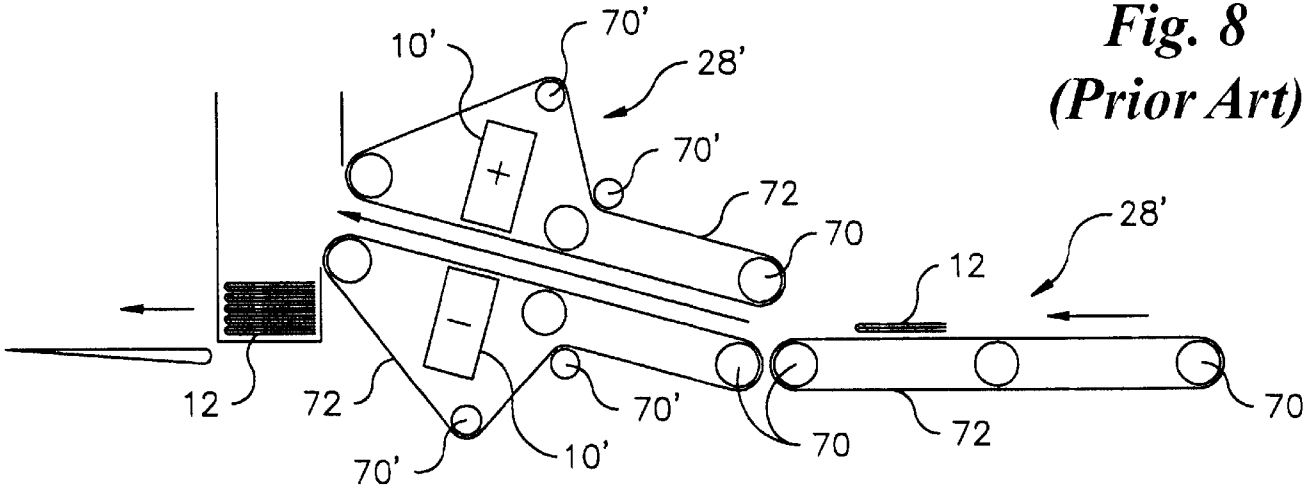
Fig. 8 (Prior Art)
FIG. 8 is a schematic view of a conveyor retrofitted to include the prior art ionizer of FIG. 1.

Referring to the drawings in detail wherein like numerals indicate like elements throughout, FIGS. 1 and 8 illustrate a prior art ionizer device, generally designated as 10'. FIGS. 2–7 and 9 illustrate a device 10 for placing a charge on an object 12 passing over the device 10 according to the present invention, generally designated as 10.

Figure 4:
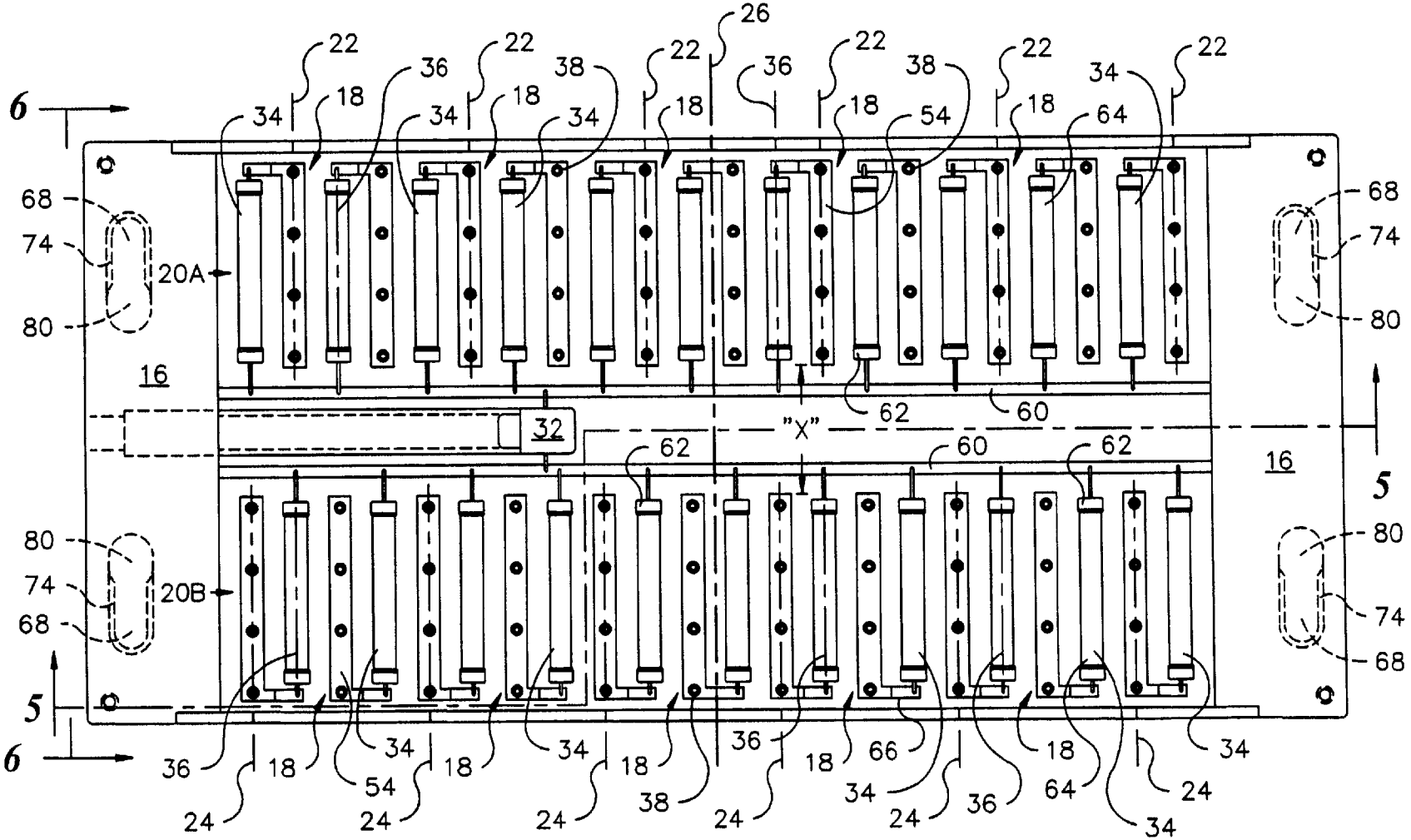
FIG. 4 is a top plan view of the device of FIG. 2 without a cover and without potting material.

The device 10 is for placing a charge on an object 12 (shown in FIG. 9) passing by and proximate to the device 10 in a first direction 30 along a transport axis 26 and includes a body 14 having a surface 16. Referring to FIG. 4, a power input 32 is preferably disposed in the body 14 for receiving power from a power source (not shown). A plurality of resistors 34 each preferably have a longitudinal resistor axis 36 and each is capable of receiving power from the power input 32. Each of the plurality of resistors 34 is preferably disposed in the body 14 with the longitudinal resistor axis 36 being generally parallel to the surface 16. A plurality of ionizing pins 38 having tips 38' is electrically connected to a least one of the plurality of resistors 34 and is capable of receiving power to generate ions. The object 12 is charged by passing the object 12 by and proximate to the surface 16 of the body 14 in the first direction 30 to receive ions generated by the plurality of ionizing pins 38 (i.e., to preferably receive ions generated by both a first plurality of rows of ionizing pins 20A and a second plurality of rows of ionizing pins 20B).

Figure 2:
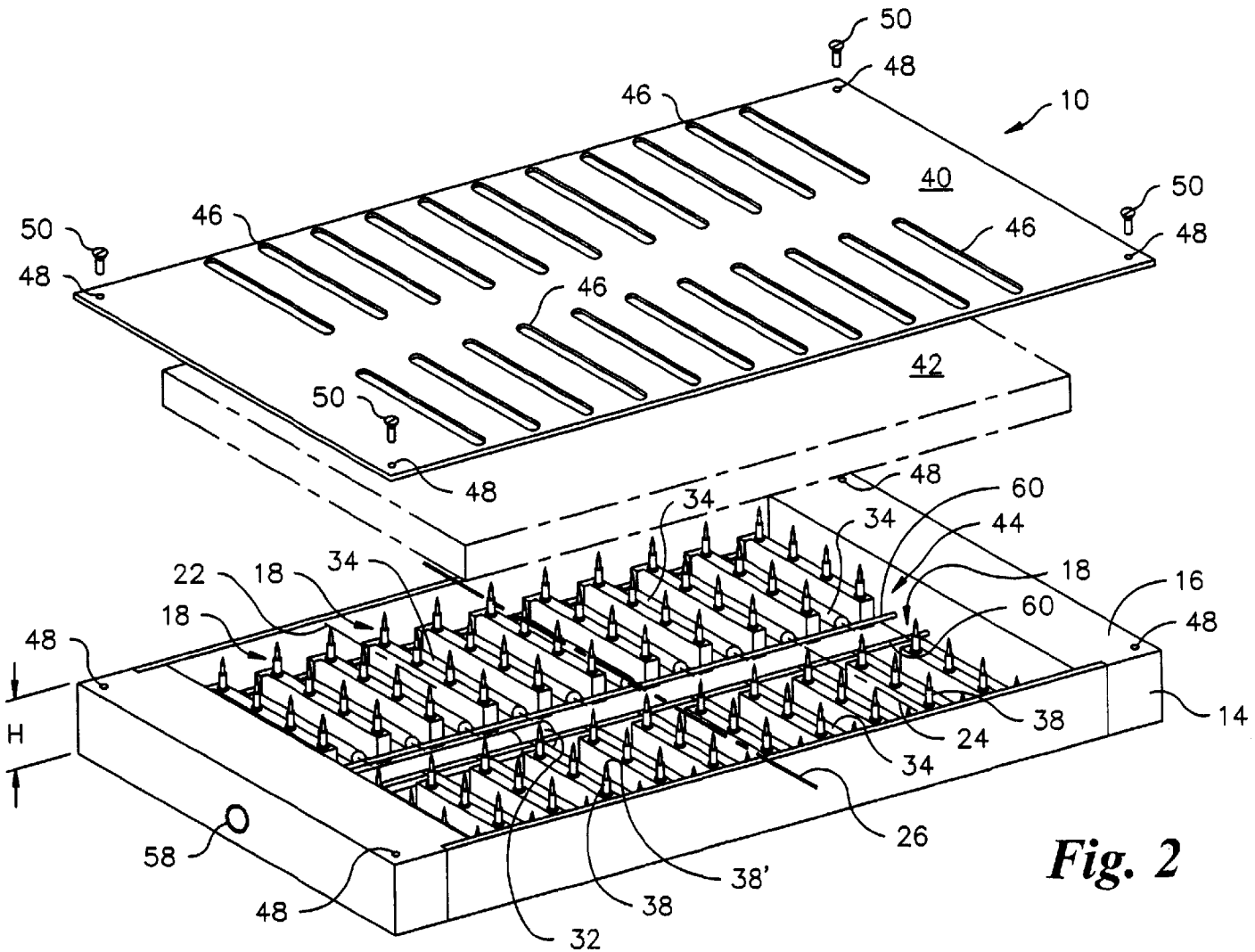
FIG. 2 is an exploded perspective view of a device for placing a charge on an object according to the present invention.

Referring to FIG. 2, an exploded view of the device 10 illustrates the device 10 with a removed cover 40 and without potting material 42 disposed in the cavity 44 of the body 14. Any conventional potting material may be used. Accordingly, further details regarding the selection or application of potting material are not necessary or included.

Figure 3:
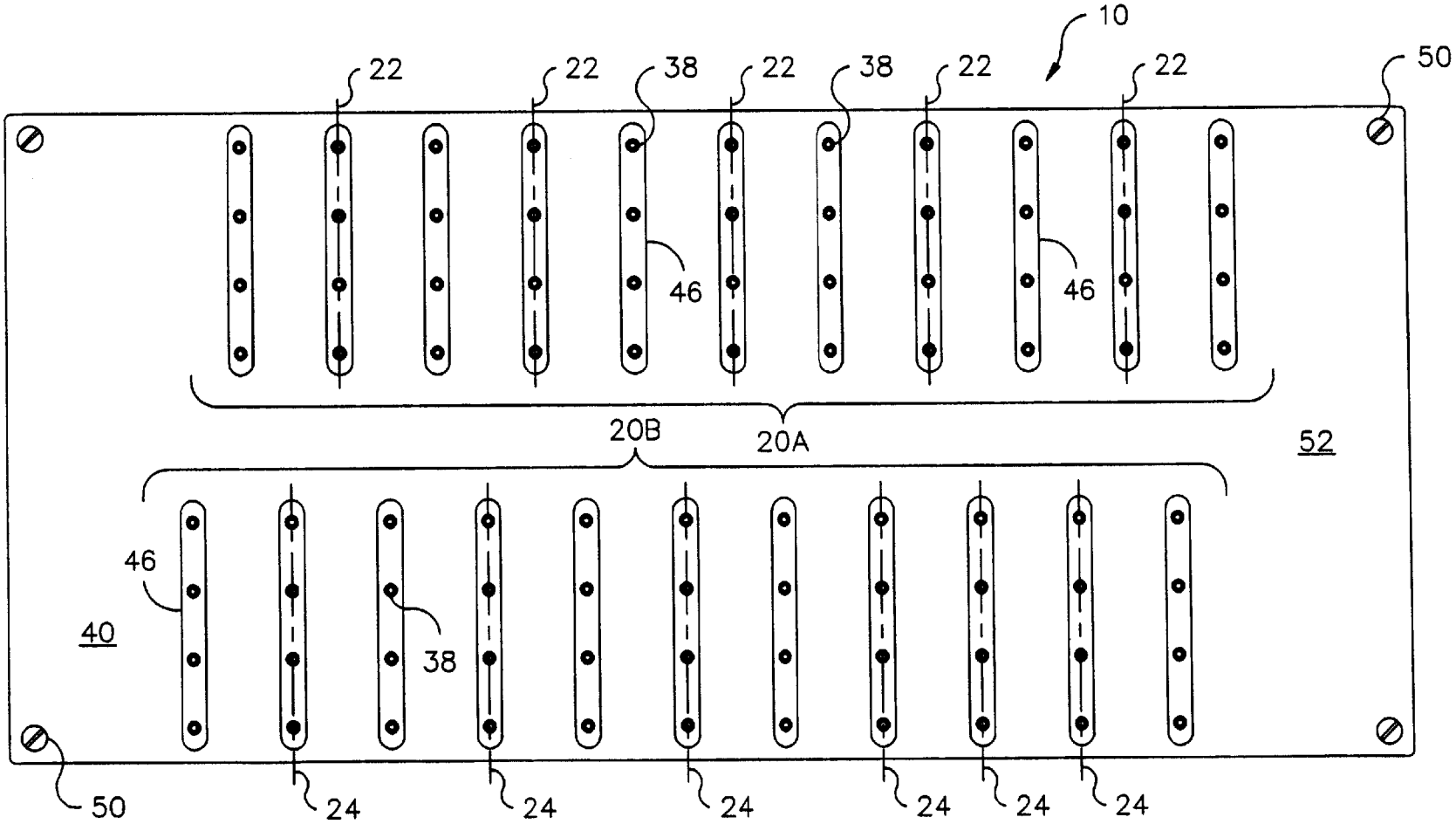
FIG. 3 is a top plan view of the device of FIG. 2.

Referring to FIGS. 3 and 4, in the preferred embodiment of the present invention, the surface 16 has a generally rectangular shape. However, the surface 16 of the present invention may be circular, hexagonal, or irregularly shaped when viewed in a top plan view. Referring to FIGS. 2 and 3, the cover 40 preferably has slots 56 through which the ionizing pins 38 emit ions. Fastener holes 48 are preferably positioned in the cover 40 and in the body 14 to allow fasteners 50 to secure the cover to the body 14.

Figure 5:
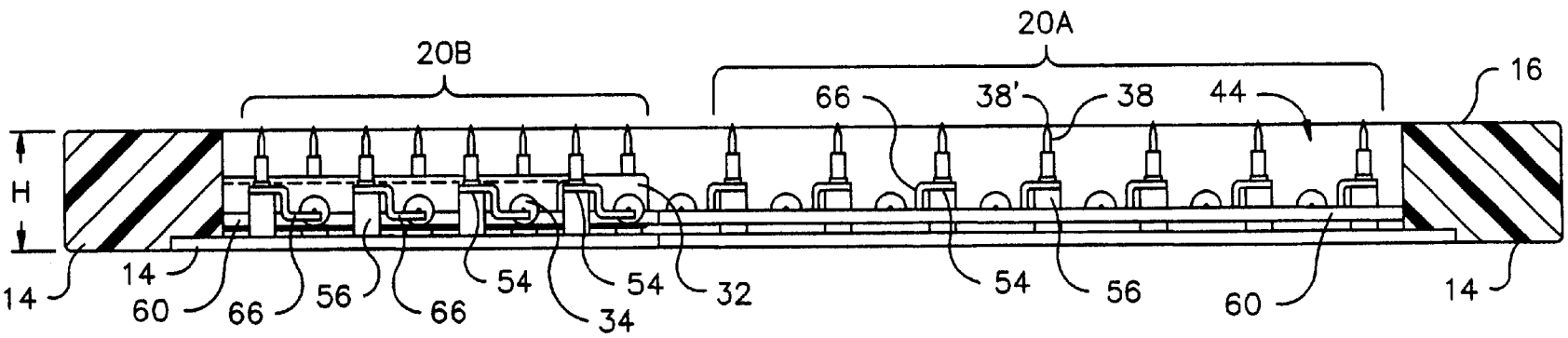
FIG. 5 is a cross-sectional view of the device of FIG. 4 as taken along the line 5—5 of FIG. 4.

The body 14 is preferably formed of a sturdy, nonconductive, durable material, such as heavy-duty polymers or the like. Referring to FIG. 5, the body 14 has a surface 16 which is preferably, but not necessarily, generally flat to allow an even distancing between each of the ionizing pins 38 and the object 12 passing by and proximate to the device 10. However, the body 14, and the corresponding surface 16, may also be curved. The use of a curved device 10 facilitates installing the device 10 at a bend in a conveyor 28.

Referring to FIGS. 3 and 4, a first plurality of rows of ionizing pins 20A is disposed in the body 14 for emitting ions from locations proximate to the surface 16 of the body 14. Referring to FIG. 2, the tips 38' of the ionizing pins 38 can protrude past the outer surface 52 of the cover 40 or can be disposed within the cavity 44 so that the tips 38' of the ionizing pins 38 are positioned below the surface 16 of the body 14 while still emitting ions from locations proximate to the surface 16 of the body 14.

As best shown in FIG. 3, there are preferably, but not necessarily, eleven rows of pins 18 in the first plurality of rows of ionizing pins 20A. However, the number of rows of pins 18 can be varied. For example, two or more rows of ionizing pins can be used as the first plurality of rows of ionizing pins 20A. Each row of pins 18 in the first plurality of rows of ionizing pins 20A preferably has four ionizing pins 38. However, the number of pins 38 in each row of pins 18 can be varied.

Referring to FIGS. 2 and 5, in the preferred embodiment of the device 10, the first plurality of rows of ionizing pins 20A faces generally outwardly from locations within the body 14. It is preferable, but not necessary, that each of the pins 38 in the first plurality of rows of ionizing pins 20A extends generally perpendicularly to the surface 16. The first plurality of rows of ionizing pins can be oriented within about thirty (30°) degrees askew from perpendicular to the closest portion of the surface 16 while still facing generally outwardly from locations from within the body 14. As detailed above, the first plurality of rows of ionizing pins 20A preferably, but not necessarily, comprises 44 ionizing pins grouped in eleven (11) rows.

Each of the first plurality of rows of ionizing pins 20A has a first row axis 22 that is preferably aligned generally parallel to the transport axis 26 (shown in FIG. 4). The first row axis 22 of each of the first plurality of rows of ionizing pins 20A can be askew from the transport axis 26 by up to about thirty (30°) degrees while still being aligned generally parallel to the transport axis. However, it is preferable, but not necessary, that the first row axes 22 of the first plurality of rows of ionizing pins 20A be askew by less than ten (10°) degrees from the transport axis 26.

Referring to FIGS. 4 and 5, the first plurality of rows of ionizing pins 20A are positioned in a generally spaced apart side by side fashion. While it is preferable that the interval between each of the first plurality of rows of ionizing pins 20A be generally the same, the interval between each of the first plurality of rows of ionizing pins 20A can vary throughout the device 10. Some of the resistors 34 can be adjacently positioned next to each other while the plurality of resistors 34 still maintains a generally spaced apart side by side layout.

In the preferred embodiment of the device 10, the ionizing pins are rated to withstand thirty (30 kV) kilovolts for three seconds without damage. The ionizing pins are also preferably removable to simplify replacement of damaged pins 38.

Referring to FIGS. 4 and 5, a second plurality of rows of ionizing pins 20B is disposed in the body 14 for emitting ions from locations proximate to the surface 16 of the body 14. As detailed above in connection with the first plurality of rows of ionizing pins 20A, the tips 38' of the individual pins 38 of the second plurality of rows of ionizing pins 20B can be positioned in various locations relative to (and at various distances from) the surface 16 or the cover 40 while still being proximate to the surface 16 of the body 14.

The second plurality of rows of ionizing pins 20B faces generally outwardly from locations within the body 14. While it is preferable that the pins 38 of the second plurality of rows of ionizing pins 20B extend generally perpendicularly toward the surface 16, the pins 38 can be askew from perpendicular by up to about thirty (30°) degrees while still facing generally outwardly from the body 14.

It is preferable, but not necessary, that the number of rows of pins 18 in the second plurality of rows of ionizing pins 20B and that the number of pins 38 in each row 18 be the same as that of the first plurality of rows of ionizing pins 20A. Accordingly, in the preferred embodiment, the second plurality of rows of ionizing pins 20B includes forty-four (44) ionizing pins 38 grouped in eleven (11) rows. The number of rows of pins 18 and the number of pins 38 in each row 18 in the second plurality of rows of ionizing pins 20B can be varied.

Referring to FIGS. 2, 4 and 5, each of the pins 38 in a single row 18 is preferably mounted on a conductive strip 54 which electrically connects each of the pins 38 to the power input 32. As best shown in FIG. 5, each conductive strip 54 is positioned over a pin mounting block 56 and is electrically connected to an end of a resistor 34. While it is preferable that a conductive strip 54 be used to electrically connect each of the pins 38 in a row of pins 18, various methods can be used to attach the individual pins 38 in each row of pins 18.

It is preferable, but not necessary, that the resistors 34 have a resistance between 80–125 megaOhms (MΩ). It is more preferable still that the resistors have a magnitude of 80 MΩ. In the preferred embodiment of the device, the resistors 34 are selected which maintain current levels below 375 $\mu$A when a 30 kV potential is supplied to the power input 32.

The resistance provided by the resistors 34 enables high voltage to be used to generate ionization while limiting the amount of current flow through the device 10 to safe levels. At voltage levels above 4 kV, corona onset occurs and the air above the pins 38 is ionized. The polarity of the power supplied to the power input 32 determines whether the ions generated by the pins 38 are negative or positive. The magnitude of the current flowing through the device depends on the magnitude of the resistors 34 used with each row of pins 18. It is preferable, but not necessary, that the power source (not shown) supply voltage having a magnitude of less than or equal to 30 kV. The power input 32 and the power source can be combined in the body of the device 10, if desired.

Referring to FIG. 2, a hole 58 is positioned in the body 14 to allow a connector to be inserted into the power input 32 to transfer power from the power supply to the device 10. The power input 32 is preferably attached to a pair of wires 60 that transfer electrical power to one end 62 of the resistors 34. Each resistor is electrically connected at another end 64 to a tab 66 of the conductive strip 54. As shown in FIGS. 2 and 4, the device 10 preferably includes the power input 32. The device 10 also includes a plurality of resistors 34 that are each disposed in the body for transferring power from the power input 32 to the first and second plurality of rows of ionizing pins 20A, 20B. Referring to FIG. 4, each of the plurality of resistors has a longitudinal resistor axis 36 preferably oriented generally parallel to the surface 16 of the body 14. The resistors 34 can be oriented so that the longitudinal resistor axes 36 are askew from parallel to the surface 16 by up to about thirty (30°) degrees while still being oriented generally parallel to the surface 16 of the body. It is preferred, but not necessary, that at least one resistor 34 is provided for each of the plurality of rows of ionizing pins 20A and that at least one resistor 34 is provided for each of the second plurality of rows of ionizing pins 20B.

It is preferable that each of the second plurality of rows of ionizing pins 20B has a second row axis 24 that is aligned generally parallel to the transport axis 26. The second row axis 24 of each of the second plurality of rows of ionizing pins 20B can be askew from the transport axis 26 by up to about thirty (30°) degrees while still being generally parallel to the transport axis 26. However, it is preferable, but not necessary, that the second row axis 24 of each of the second plurality of rows of ionizing pins be askew from the transport axis 26 by no more than ten (10°) degrees.

Referring to FIGS. 3 and 5, the second plurality of rows of ionizing pins 20B are preferably positioned in a generally spaced apart side by side fashion. Some of the resistors 34 can be disposed adjacently next to each other while the second plurality of rows of ionizing pins 20B are still positioned in a generally spaced apart side by side fashion. By staggering the pins 38 in the fashion shown in FIG. 4, the dwell time of an object 12 passing by and proximate to the surface 16 of the device 10 is increased. This allows the device 10 to more effectively place a charge on difficult to charge objects 12, such as catalogs, telephone books or the like.

The second plurality of rows of ionizing pins 20B are preferably positioned in a generally spaced apart side by side fashion. The first plurality of rows of ionizing pins 20A and the second plurality of row of ionizing pins 20B are preferably disposed so that at least a portion of the object 12 moving in the first direction 30 by and proximate to the surface 16 of the body 14 passes by and proximate to at least one (1) of the first plurality of rows of ionizing pins 20A before passing by and proximate to at least one of the second plurality of rows of ionizing pins 20B. Referring to FIG. 4, it is preferable, but not necessary, that the first plurality of rows of ionizing pins 20A and the second plurality of rows of ionizing pins 20B are spaced apart by a predetermined distance (denoted "X" in FIG. 4) as measured in a direction parallel to the transport axis 26. Alternatively, it is preferable but not necessary, that the first and second plurality of rows of ionizing pins 20A, 20B are disposed in the body 14 so that at least a portion of an object 12 moving by and proximate to the surface 16 of the body 14 in the first direction 30 passes by and proximate to at least one of the first plurality of rows of ionizing pins 20A before beginning to pass by and proximate to one of the second plurality of rows of ionizing pins 20B.

Referring to FIGS. 2 and 3, it is preferable, but not necessary, that the second plurality of rows of ionizing pins 20B are laterally offset with respect to the first plurality of rows of ionizing pins 20A so that the second plurality of rows of ionizing pins 20B are generally aligned with positions between pairs of the first plurality of rows of ionizing pins 20A. The staggering of the first and second rows of ionizing pins 20A, 20B relative to each other tends to even out the application of ions onto the object 12. Each of the pins 38 tends to emit ions in a conical fashion with the most ions being emitted toward the center of the cone. Thus, by offsetting the first and second rows of ionizing pins 20A, 20B, the resulting charge placed on the object is more evenly distributed over the entire treated surface of the object.

Figure 9:
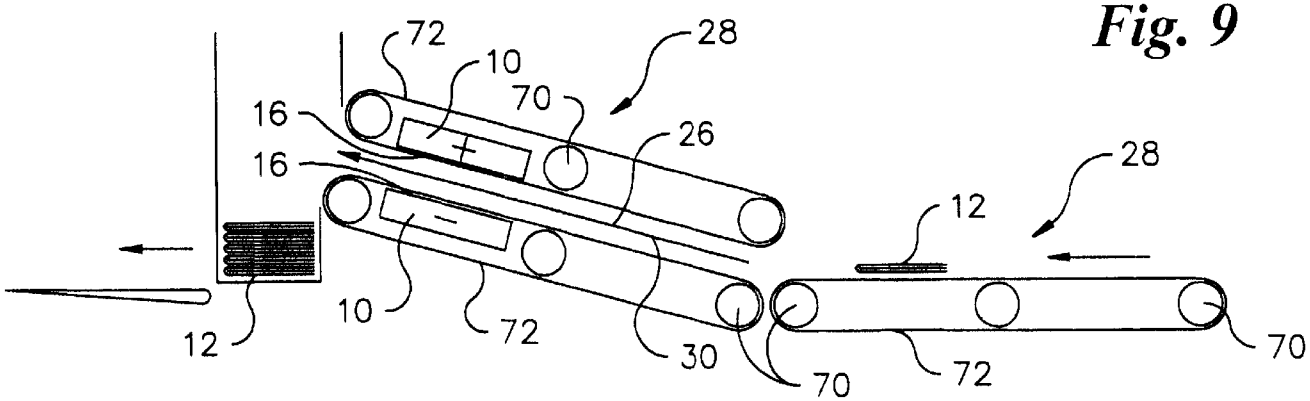
FIG. 9 is a schematic view of a conveyor retrofitted to include the device of the present invention (i.e., the device of FIG. 2).

Referring to FIG. 9, the present invention is alternatively directed to a method of retrofitting a belt conveyor 28 with a device 10 to allow a charge to be placed on an object 12 being transported in a first direction 30 along a transport axis 26 on the belt conveyor 28. The belt conveyor 28 preferably has a portion moving in the first direction 30 for supporting and transporting the object 12. Referring to FIGS. 8 and 9, each conveyor 28 preferably has a plurality of rollers 70 that support a belt 72. As shown in FIG. 8, when installing a conventional ionizer 10' onto belt conveyors 28', it is often necessary to reroute the path of the belt 72 using additional rollers 70' to provide the necessary space between opposing portions of the belt 72 to insert the conventional ionizer 10'.

Referring to FIG. 9, while the preferred embodiment of the conveyor 28 is an endless belt conveyor, the device 10 can alternatively be used with a pallet transport system, an O-ring conveyor, a drag type conveyor, a sheet conveyor, a pneumatic conveyor, a roller conveyor, a chain conveyor, or with another transport or conveyor systems.

The device 10 has a surface 16 and is capable of emitting ions from locations proximate to the surface. The device 10 preferably includes a plurality of resistors 34 each having a longitudinal resistor axis 36 orientated generally parallel to the surface 16 which results in the device 10 having a reduced height (denoted "H" in FIGS. 2 and 5) as measured perpendicularly to the surface 16. The resistor axis 36 can be askew from parallel with the surface 16 of the device 10 by up to about thirty (30°) degrees while still being generally parallel to the surface 16.

The method of the present invention includes positioning the device 10 proximate to the belt conveyor 28. Referring to FIGS. 6 and 7, mounting holes 68 are preferably positioned in a side of the device 10 opposite from the surface 16. Each mounting hole 68 is generally elliptically shaped and has a lip 74 disposed about roughly half of the opening 76 of the hole 68 to create a thinner portion 78. Referring to FIG. 6, the lip 74 allows a fastener head to be inserted through a larger portion 80 of the hole 68, slid underneath the lip 74 and abuttingly secured against the lip 74. It is preferable that an insulator be positioned between the device 10 and the structure to which the device 10 is mounted when securing the device 10.

The method of the present invention includes orienting the device 10 so that the surface 16 faces the portion of the belt conveyor 28 moving in the first direction 30 to allow the device 10 to place the charge on the object 12 being transported by the belt conveyor 28. By orienting the surface 16 toward the expected path of the object 12, the pins 38 are properly aligned to place a charge on the object 12. The method of the present invention further includes securing the device in position whereby the reduced height "H" of the device simplifies the retrofitting of the belt conveyor 28 to include the device 10.

Referring to FIGS. 2–7 and 9, in operation, the device 10 of the present invention is preferably disposed proximate to the transport path of an object 12. A power supply is connected to a device 10 via the power input 32. Power is transferred from the power input 32 to wires 60 which are electrically connected to resistors 34 in the device 10. The resistors 34 transfer the power to rows of pins 18 while maintaining lower current levels to prevent the arcing of electricity. The voltage supplied to the pins causes corona onset to occur and air above the surface 16 is ionized. As the object 12 passes through the ionized air, a charge is placed on the object 12. While FIG. 9 shows one device 10 installed on either side of the transportation axis 26, a single device 10 can be used opposite from a device maintained at ground potential to place a charge on an object 12.

The device 10 of the present invention uses a resistor 34 orientation which results in a greatly reduced device height "H" which simplifies the retrofitting of a preexisting structure to include the device 10. Additionally, the layout of the pins 38 results in an increased dwell time for passing objects 12 which enhances the ability of the device 10 to place a charge on the object 12. This increased dwell time results in effectively placing charges on objects 12 that heretofore were difficult, if not impossible, to charge, such as thick UV coated catalogs or the like.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A device for placing a charge on an object passing by and proximate to the device in a first direction along a transport axis, the device comprising:

a body having a surface;

a first row of ionizing pins disposed in the body for emitting ions from locations proximate to the surface of the body, each of the first row of ionizing pins defining a first row axis that is aligned generally parallel to the transport axis, the first row of ionizing pins are positioned in a generally spaced apart side by side fashion;

a second row of ionizing pins disposed in the body for emitting ions from locations proximate to the surface of the body, each of the second row of ionizing pins defining a second row axis that is aligned generally parallel to the transport axis, the second row of ionizing pins are positioned in a generally spaced apart side by side fashion, the first and second rows of ionizing pins being disposed so that at least a portion of the object moving in the first direction by and proximate to the surface of the body passes by and proximate to the first row of ionizing pins before passing by and proximate to the second row of ionizing pins, at least one ionizing pin of the second row of ionizing pins being laterally offset with respect to the first row of ionizing pins so that the at least one laterally offset ionizing pin of the second row of ionizing pins is generally aligned with a position between a pair of ionizing pins of the first row of ionizing pins; and whereby the object is charged by passing the object by and proximate to the surface of the body in the first direction to receive ions generated from both the first row of ionizing pins and the second row of ionizing pins.

2. The device of claim 1 further comprising:

a power input disposed in or on the body; and at least one resistor for transferring power from the power input to a portion of the ionizing pins, the at least one resistor having a longitudinal resistor axis oriented generally parallel to the surface of the body.

3. The device of claim 2 further comprising a strip of conductive material having a longitudinal strip axis and electrically coupled to the at least one resistor, the longitudinal strip axis being generally parallel to the surface, the portion of the ionizing pins being connected to the strip of conductive material so as to receive power from the at least one resistor.

4. The device of claim 1 wherein the first row of ionizing pins faces generally outwardly from locations within the body and the second row of ionizing pins faces generally outwardly from locations within the body.

5. The device of claim 1 wherein the number of ionizing pins in the first row of ionizing pins is different than the number of ionizing pins in the second row of ionizing pins.

6. The device of claim 1 wherein the entire second row of ionizing pins are laterally offset with respect to the entire first row of ionizing pins so that the second row of ionizing pins is generally aligned with approximately central positions between each adjacent pair of ionizing pins of the first row of ionizing pins.

7. The device of claim 1 wherein the first row of ionizing pins and the second row of ionizing pins are spaced apart by a predetermined distance as measured in a direction parallel to the transport axis.

8. A device for placing a charge on an object passing by and proximate to the device in a first direction along a transport axis, the device comprising:

a body having a surface;

a power input disposed in or on the body;

at least one resistor having a longitudinal resistor axis and capable of receiving power from the power input, the longitudinal resistor axis being generally parallel to the surface;

a plurality of ionizing pins each electrically coupled to the at least one resistor for receiving power to generate ions; and whereby the object is charged by passing the object by and proximate to the surface of the body in the first direction to receive ions generated by the plurality of ionizing pins.

9. The device of claim 8 wherein the plurality of ionizing pins are organized into one of a first row of ionizing pins and a second row of ionizing pins, the first row of ionizing pins defining a first row axis that is aligned generally parallel to the transport axis, the first row of ionizing pins being positioned in a generally spaced apart side by side fashion, the second row of ionizing pins defining a second row axis that is aligned generally parallel to the transport axis, the second row of ionizing pins being positioned in a generally spaced apart side by side fashion.

10. The device of claim 9 wherein the first and second rows of ionizing pins are disposed in the body so that at least a portion of an object moving by and proximate to the surface of the body in the first direction passes by and proximate to the first row of ionizing pins before beginning to pass by and proximate to the second row of ionizing pins, at least one ionizing pin of the second row of ionizing pins being laterally offset with respect to the first row of ionizing pins so that the at least one laterally offset ionizing pin of the second row of ionizing pins is generally aligned with a position between a pair of ionizing pins of the first row of ionizing pins.

11. The device of claim 8 further comprising a strip of conductive material having a longitudinal strip axis and electrically coupled to the at least one resistor, the longitudinal strip axis being generally parallel to the surface, at least a portion of the ionizing pins being connected to the strip of conductive material so as to receive power from the at least one resistor.

12. A method of retrofitting a belt conveyor with a device to allow a charge to be placed on an object being transported in a first direction along a transport axis on the belt conveyor, the belt conveyor having a portion moving in the first direction for supporting and transporting the object, the device having a surface, a first ion emitting source capable of emitting ions from a first location proximate to the surface and a second ion emitting source capable of emitting ions from a second location proximate to the surface, the second location being laterally offset from the first location and being linearly offset from the first location relative to the transport axis, the method comprising:

positioning a device proximate to the belt conveyor so that the surface faces the portion of the belt conveyor moving in the first direction to allow the device to place the charge on the object being transported by the belt conveyor; and orienting the device such that an object being transported by the belt conveyor moving in the first direction will pass the first location prior to passing the second location.

13. A device for placing a charge on an object being transported in a first direction along a transport axis on a belt conveyor, the belt conveyor having a portion moving in the first direction for supporting and transporting the object, the device comprising:

a body having a surface;

a first ion emitting source capable of emitting ions from a first location proximate to the surface; and a second ion emitting source capable of emitting ions from a second location proximate to the surface, the second location being laterally offset from the first location and being linearly offset from the first location relative to the transport axis so that the surface faces the portion of the belt conveyor moving in the first direction to allow the device to place the charge on the object being transported by the belt conveyor.

* * * * *